US005998719A

United States Patent [19]

Chuang

[11] Patent Number: 5,998,719

[45] Date of Patent: Dec. 7, 1999

[54] BASS DRUM BEATER HAVING A MOVABLE AND REPLACEABLE POLL

[75] Inventor: Chi-Hua Chuang, Taipei, Taiwan

[73] Assignee: Reliance International Corp., Taipei, Taiwan

[21] Appl. No.: 09/225,689

[22] Filed: Jan. 6, 1999

[51] Int. Cl.[6] ..... G10D 13/02

[52] U.S. Cl. ..... 84/422.4

[58] Field of Search ..... 84/411 R, 422.1, 84/422.4, 254, 323, 404

[56] References Cited

U.S. PATENT DOCUMENTS

| | | | |
|---|---|---|---|
| 1,343,164 | 6/1920 | Smith | 84/422.1 |
| 2,586,163 | 2/1952 | Heiderich et al. | 84/422.4 |
| 2,853,912 | 9/1958 | Gladstone | 84/422.4 |
| 3,411,395 | 11/1968 | Hanes | 84/422.4 |
| 4,023,461 | 5/1977 | Brandolino | 84/422.1 |
| 4,632,006 | 12/1986 | Ambroszewski | 84/422.4 |
| 5,317,946 | 6/1994 | Hoshino | 84/422.1 |
| 5,526,728 | 6/1996 | Behrenfeld | 84/422.1 |
| 5,610,351 | 3/1997 | Yanagisawa | 84/422.1 |

FOREIGN PATENT DOCUMENTS

| | | |
|---|---|---|
| 3833568 | 4/1990 | Germany . |
| 27823 | of 1911 | United Kingdom . |

OTHER PUBLICATIONS

Brookstein Music Company advertisement, "The Music Trades," p. 84, Mar. 1964.

*Primary Examiner*—Robert E. Nappi
*Assistant Examiner*—Wesley Scott Ashton
*Attorney, Agent, or Firm*—Bacon & Thomas, PLLC

[57] ABSTRACT

A beater for a bass drum includes a head having an adjustment hole, a shaft rotatably mounted in the head above the adjustment hole, and a stem fixedly connected to the shaft and extended out of the adjustment hole for connection to the pedal drive of a bass drum, wherein the stem can be turned in the adjustment hole within a limited angle to change the contained angle between the head and the stem so that the face of the head can positively fit the head of the bass drum.

3 Claims, 6 Drawing Sheets

BASS DRUM BEATER HAVING A MOVABLE AND REPLACEABLE POLL

BACKGROUND OF THE INVENTION

The present invention relates to a beater for a bass drum, and more particularly to such a beater in which the poll of the head of the beater is replaceable.

A regular bass drum is generally comprised of a pedal drive, and a beater coupled to the pedal drive and driven by it to beat the head of the bass drum (see FIG. 1). Because the head of the beater directly hits the head surface of the bass drum, it wears quickly with use. When the head of the beater starts to wear, the quality of the tone of the bass drum is affected. However, because the head is fixedly connected to the stem of the beater and not replaceable, the beater must be replaced wholly when the head starts to wear.

SUMMARY OF THE INVENTION

It is one object of the present invention to provide a beater that can be adjusted to fit the head of the bass drum perfectly when it starts to wear. It is another object of the present invention to provide a beater which has a replaceable poll at its head for striking the head of the bass drum. According to one embodiment of the present invention, the beater comprises a head having an adjustment hole, a shaft rotatably mounted in the head above the adjustment hole, and a stem fixedly connected to the shaft and extended out of the adjustment hole for connection to the pedal drive of a bass drum, wherein the stem can be turned in the adjustment hole within a limited angle to change the contained angle between the head and the stem so that the face of the head can positively fit the head of the bass drum.

DETAILED DESCRIPTION OF THE PREFERRED EMBODIMENT

Figure 1:
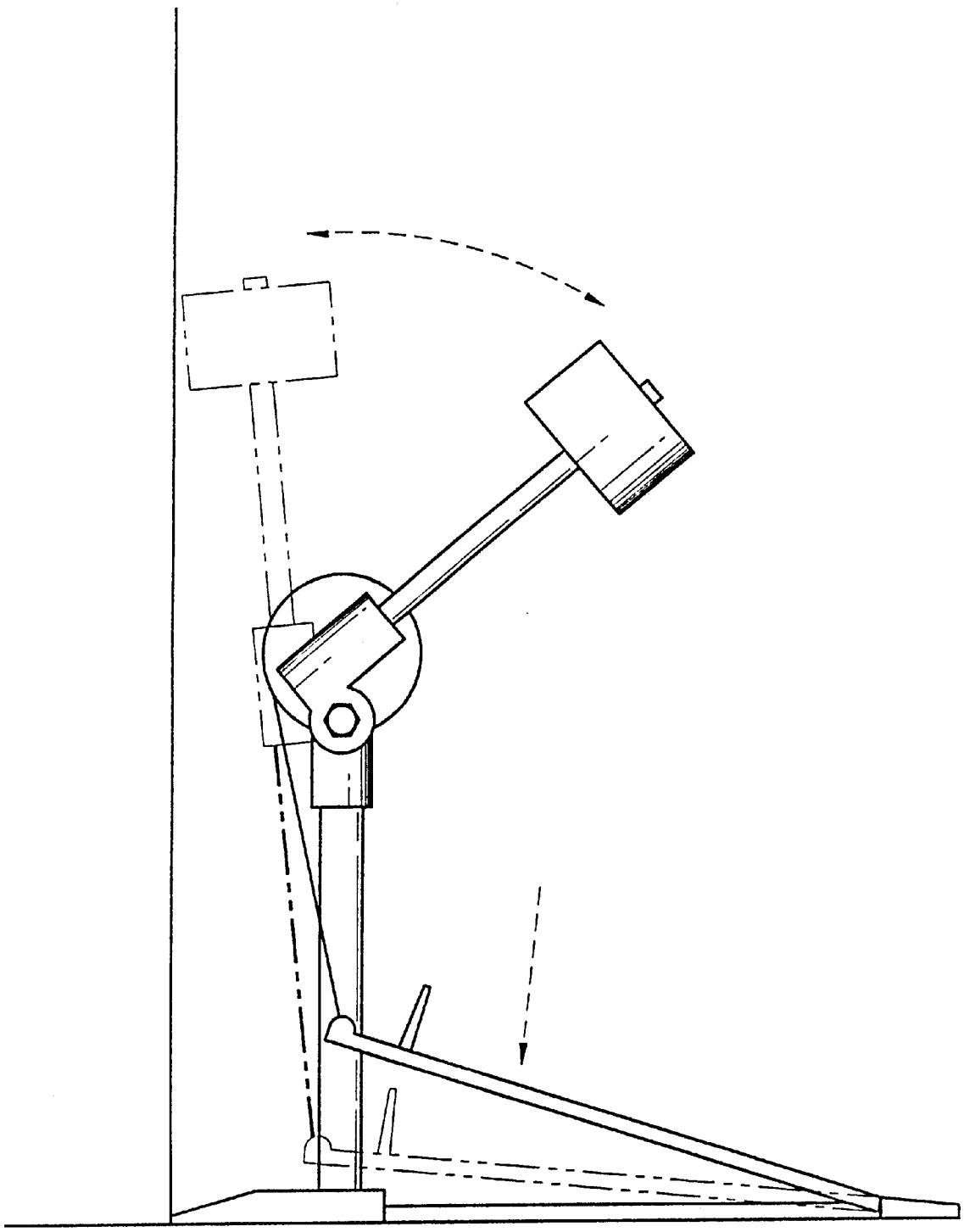
Fig. 1 PRIOR ART
FIG. 1 illustrates a beater coupled to the pedal drive of a bass drum and operated according to the prior art.
Figure 2:
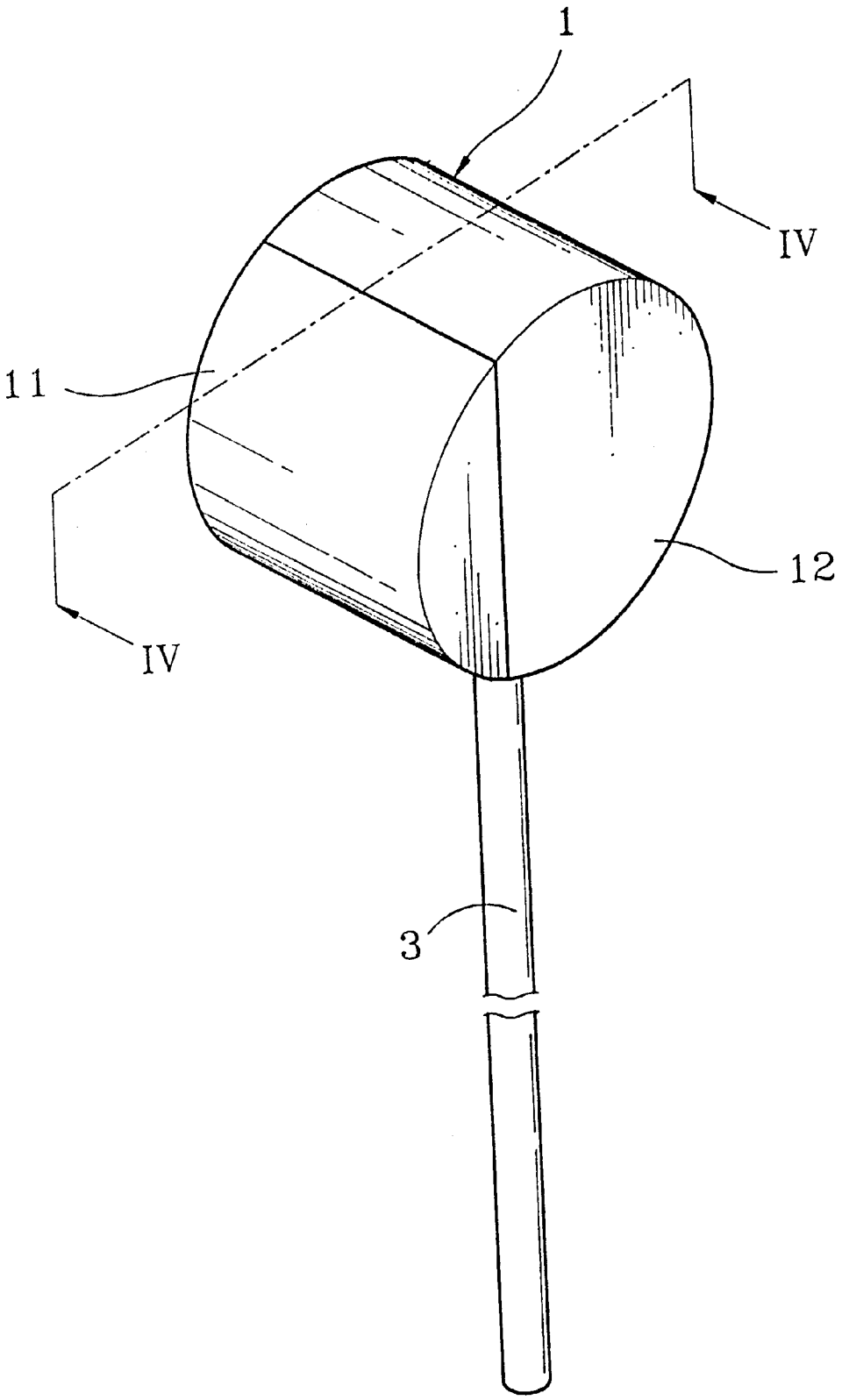
FIG. 2 is a perspective view of a beater for a bass drum according to one embodiment of the present invention.
Figure 3:
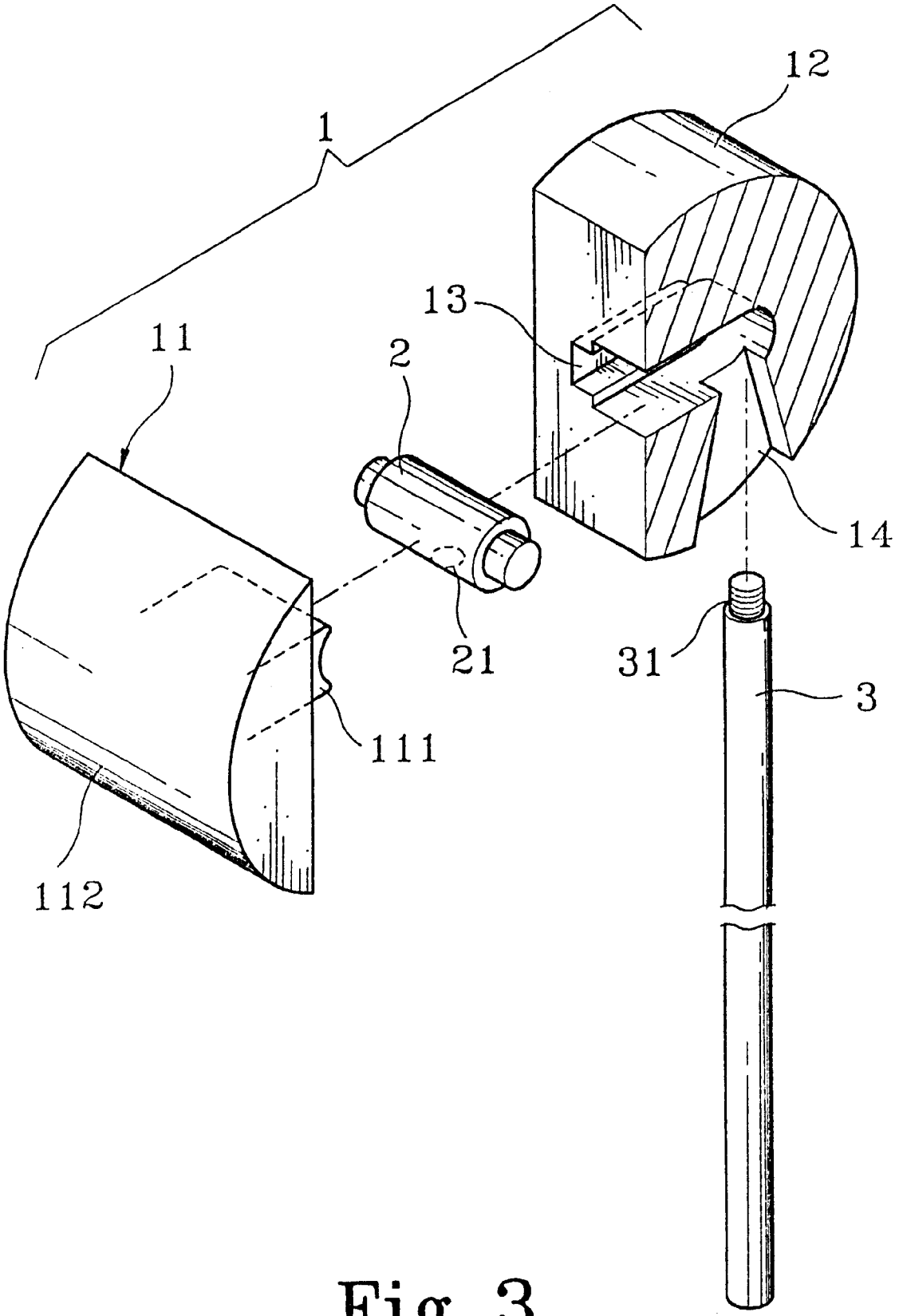
FIG. 3 is an exploded view of the beater shown in FIG. 2.

Referring to FIGS. 2 and 3, a beater in accordance with the present invention is generally comprised of a head 1, a shaft 2, and a stem 3. The head 1 is comprised of a poll 11, and a base 12. The base 12 of the head 1 comprises a horizontal coupling hole 13 extended to the flat front side wall thereof on the middle, and a vertical adjustment hole 14 downwardly extended from the horizontal coupling hole 13 to the bottom side wall thereof. The width of the vertical adjustment hole 14 gradually increases from the horizontal coupling hole 13 toward the bottom side wall of the base 12. The poll 11 comprises a coupling block 111 perpendicularly raised from the flat back side wall thereof and press-fitted into the horizontal coupling hole 13 at the base 12, and a smoothly arched front side wall 112 for striking the head of the bass drum. The shaft 2 is cylindrical in shape and is transversely mounted in the horizontal coupling hole 13 at the center of the base 12, having a screw hole 21 at its periphery. The stem 3 is inserted through the vertical adjustment hole 14 at the base 12, having a screw rod 31 at its one end threaded into the screw hole 21 at the shaft 2. The opposite end of the stem 3 is connected to the pedal drive 4 of the bass drum (see FIG. 6).

Figure 4:
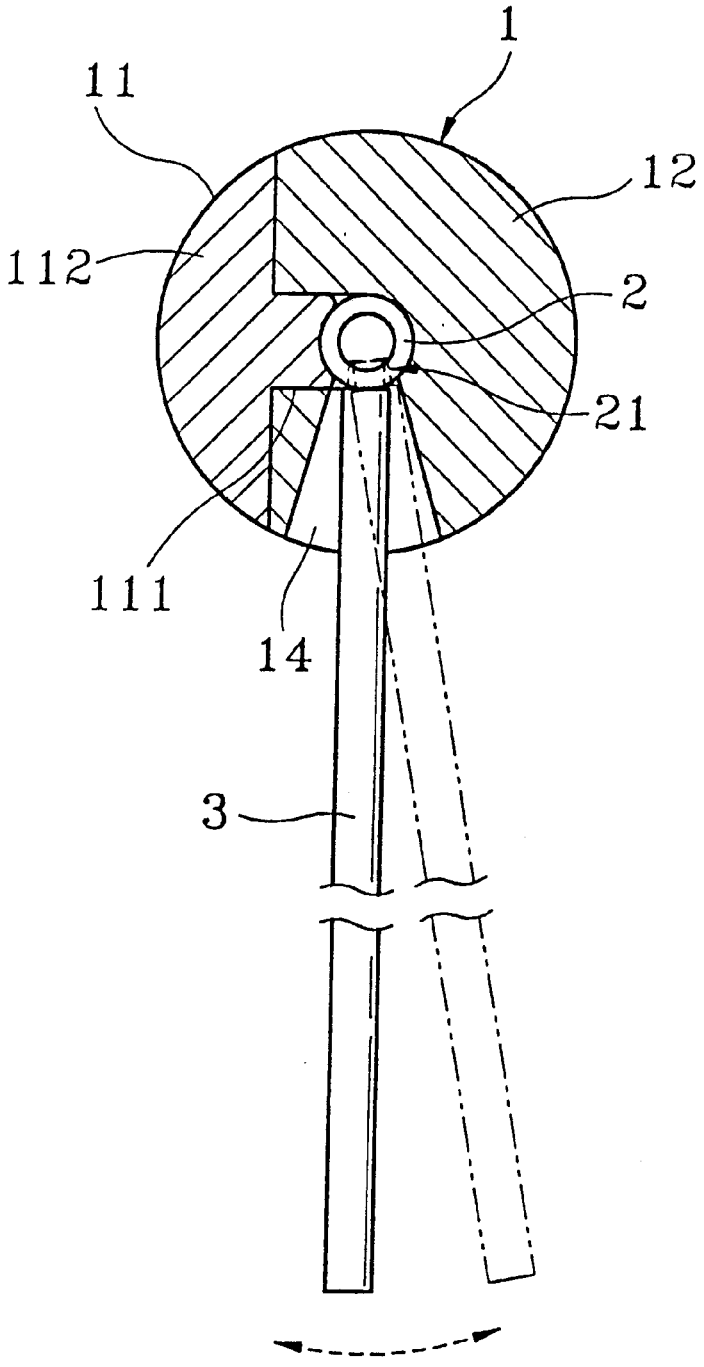
FIG. 4 is a sectional view taken along line IV—IV of FIG. 2.

Referring to FIG. 4, when the beater is assembled, the shaft 2 is fixedly connected to the stem 3 in the horizontal coupling hole 13 above the vertical adjustment hole 14, and peripherally disposed in close contact with a corresponding smoothly recessed surface of the coupling block 111 of the poll 11. The stem 3 can be turned or pivoted back and forth in the vertical adjustment hole 14 about a pivot axis defined by the longitudinal axis of shaft 2 to change the contained angle between the head 1 and the stem 3, so as to adjust the angular position of the smoothly arched front side wall 112 of the poll 11 relative to the stem 3, enabling the smoothly arched front side wall 112 to be aligned with and strike the head surface of the drum (see FIG. 6) positively.

Figure 5:
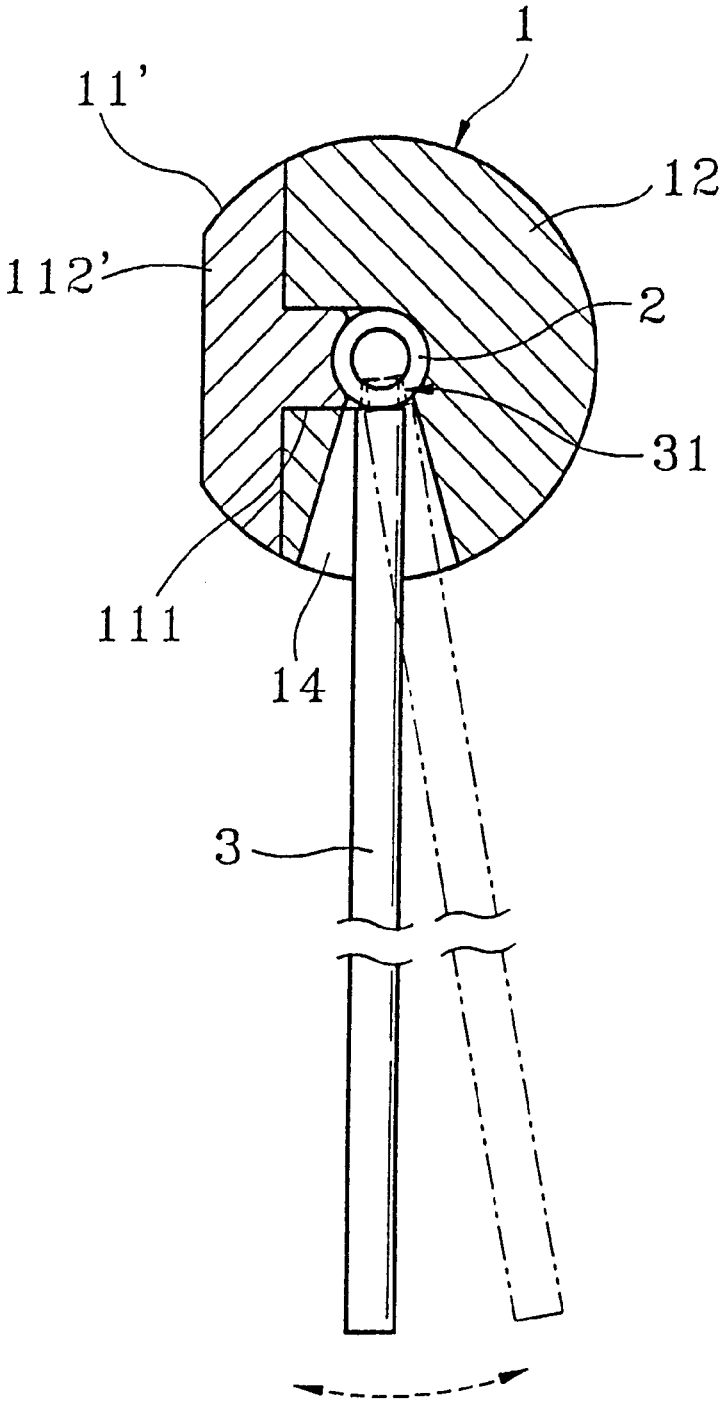
FIG. 5 is a sectional view of an alternate form of the beater according to the present invention.

FIG. 5 shows an alternate form of the present invention. According to this alternate form, the poll 11' has a flat front side wall 112' for striking the head of the drum.

Figure 6:
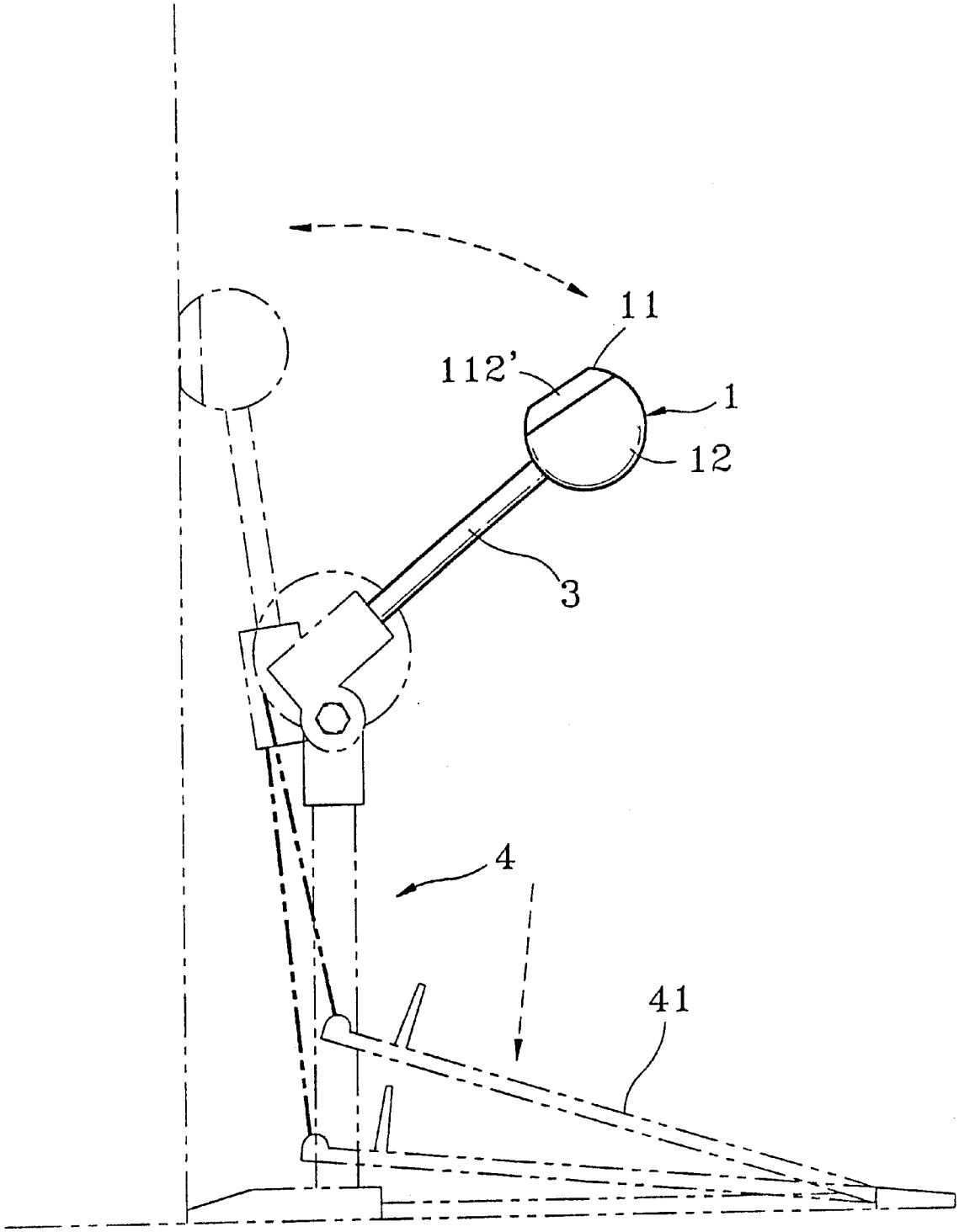
FIG. 6 illustrates the beater of FIG. 5 installed in the pedal drive of a bass drum and operated.

Referring to FIG. 6, the stem 3 is fixedly connected to the pedal drive 4 of the bass drum. When the pedal 41 of the pedal drive 4 is pressed down, the stem 3 is turned forwards, causing the front side wall 112' of the poll 11' to strike the head of the bass drum. Because the flat front side wall 112' of the poll 11' is maintained in close contact with the head of the bass drum upon each striking, reactive force (and its components of force) forces the coupling block 111 into tight engagement with the shaft 2 in the horizontal coupling hole 13. Further, when the poll 11' start to wear after a long use, the poll 11' can be disconnected from the base 12 for a replacement.

What is claimed is:

1. A beater for a bass drum comprising:

a) a head including a poll and a base, the base having a horizontal coupling hole and a vertical adjustment hole formed therein, the coupling and adjustment holes being disposed at a right angle to each other;

b) a cylindrical shaft transversely mounted within the coupling hole and positioned at the center of the base, the shaft having a screw hole facing the adjustment hole;

c) the poll including a front side wall for striking a drum surface and a back wall, a coupling block extending from the back wall and terminating in an end having a recessed surface, the coupling block being press fitted within the coupling hole and the recessed surface being disposed in contact with the shaft;

d) a stem having a first end including a screw rod disposed within the adjustment hole and engaged with the screw hole of the shaft, and a second end for connecting to a pedal drive; and e) whereby the stem is pivotable about a pivot axis defined by a longitudinal axis of the shaft and within a contained angle defined by the adjustment hole in order to permit alignment of the front side wall of the poll with the surface of the drum.

2. The beater of claim 1 wherein the front side wall of the poll has a smoothly arched configuration.

3. The beater of claim 1 wherein the front side wall of the poll has a flat configuration.

* * * * *